US005150660A

United States Patent [19]

Kuczynski

[11] Patent Number: 5,150,660

[45] Date of Patent: Sep. 29, 1992

[54] FABRIC MATERIAL AND CLOTHING APPAREL AND APPAREL ACCESSORIES MADE THEREFROM

[75] Inventor: Charles P. Kuczynski, Bayonne, N.J.

[73] Assignee: Ty-Breakers Corp., Hackensack, N.J.

[21] Appl. No.: 650,499

[22] Filed: Feb. 5, 1991

[51] Int. Cl.[5] ..... D05B 93/00

[52] U.S. Cl. ..... 112/402; 2/82; 428/284; 428/286; 428/296; 428/298

[58] Field of Search ..... 428/284, 286, 296, 298, 428/102; 112/402, 428; 2/82

[56] References Cited

U.S. PATENT DOCUMENTS

| | | | |
|---|---|---|---|
| 3,563,842 | 2/1971 | Thomas | 161/92 |
| 3,949,130 | 4/1976 | Sabee et al. | 428/296 |
| 4,147,829 | 4/1979 | Holland | 428/311 |
| 4,272,851 | 6/1981 | Goldstein | 2/79 |
| 4,555,293 | 11/1985 | French | 156/308.4 |
| 4,670,073 | 6/1987 | Langley | 156/73.1 |
| 4,683,593 | 8/1987 | Langley | 2/82 |
| 4,753,182 | 6/1988 | Blackburn | 112/419 |
| 4,797,253 | 1/1989 | Peterson | 428/196 |
| 4,860,382 | 8/1989 | Markwell | 2/82 |
| 4,872,220 | 10/1989 | Haruvy et al. | 2/243 A |
| 4,897,296 | 1/1990 | Marshall, Jr. | 428/102 |

*Primary Examiner*—James J. Bell
*Attorney, Agent, or Firm*—Morgan & Finnegan

[57] ABSTRACT

A new material useful for making clothing apparel and apparel accessories having a good hand and substantial feel which comprises an outer layer of a non-woven spun bonded olefin to which is sewn or bonded a fabric liner layer of natural or synthetic fibers or blends thereof which optionally may be fleeced.

15 Claims, No Drawings

FABRIC MATERIAL AND CLOTHING APPAREL AND APPAREL ACCESSORIES MADE THEREFROM

This invention relates to a material useful for making clothing apparel which comprises an outer layer of a non-woven spun bonded olefin to which is sewn or bonded a fabric liner layer of a natural or synthetic fabric material or blends of natural and synthetic material which can optionally be fleeced.

BACKGROUND OF THE INVENTION

Non-woven spun bonded polyolefin material has been used in the making of hazardous area apparel (e.g., in the asbestos removal business). One example of such a non-woven polyolefin fabric is a material sold by Dupont under the trademark "TYVEK". This material is waterproof, windproof and is both weather resistant and resistant to attack by a variety of harmful dry particulates and certain hazardous chemicals.

Unlined wearing apparel made from "TYVEK" such as jackets is a relatively new concept (within about the last five years). However, because of the nature of "TYVEK" itself, such jackets were not too substantial and had a paper feel. Additionally, such garments while being resistant to weather were not able to keep a wearer particularly warm.

SUMMARY OF THE INVENTION

It is an object of the present invention to make a new material useful for making clothing apparel and apparel accessories by using a "TYVEK" material in conjunction with other fabrics wherein the new material does not have a paper feel.

A further object is to make a new material for making clothing apparel using a "TYVEK" material in conjunction with other fabrics which has a substantial feel and a good hand.

A still further object of the present invention is to make clothing apparel from the new material which is warmer than the "TYVEK" material alone.

Briefly, but not by way of limitation, the present invention relates to a new material useful for making clothing apparel and apparel accessories made from this new material. The new material comprises a layer which will be the outer portion of the apparel (outer layer) which is a non-woven spun-bonded olefin fabric and an inner layer which will be the lining of the apparel (lining layer) and which is a fabric of a natural or synthetic fiber or blends thereof. The lining material is sewn or bonded to the outer layer, preferably sewn. This new material makes possible the manufacture of a wide range of clothing apparel such as jackets, sweatshirts, sweatpants, shorts, skirts and apparel accessories such as hats, handbags, tote bags and carrying bags.

Quite surprisingly, the new material obtained by adding a fabric lining to an outer layer of a "TYVEK" type material was a completely new material which had a feel which was quite unexpected. The resulting new material feels much more substantial and is completely different from the paper feel of a sheet of "TYVEK" type material alone. This overcomes a major impediment of apparel and apparel accessories made of "TYVEK" type material alone. People in the trade describe the new material as having a better hand. Apparel made from the new material is also warmer and more comfortable feeling than apparel made from "TYVEK" type material alone. The inner shell of apparel made from the new material is softer than the hard coarseness of "TYVEK" alone.

The fabric lining can be attached to the "TYVEK" layer by various means known to those skilled in the art, such as bonding or sewing. A preferred way of attachment is by sewing.

On making apparel from an unlined "TYVEK" type material, the sewing stitches cannot be too close together. If sewn with stitches too close together, the apparel is weakened by essentially punching too many holes in the "TYVEK" material. In sewn apparel from unlined "TYVEK", the stitches are normally no more than seven per inch.

In the case of the new material according to the present invention, one would expect that the same sewing limitation would occur as with the unlined material. Quite surprisingly, seams are strengthened by the use of at least eleven stitches per inch.

A preferred material for the outer layer of the new material is the non-woven spun bonded olefin sold under the trademark "TYVEK" by Dupont. The fabric lining material can be made from various natural and synthetic fibers or fabrics or a blend of natural and synthetic fibers and can be optionally fleeced. Lining material can be cotton or cotton/blend. A cotton/-polyester blend is preferred because of the shrink-resistance upon washing of such blend fabrics. Since "TYVEK" type materials will not shrink when washed, it is desireable to use a lining material which is shrink resistant upon washing to prevent distortion of the apparel after washing.

Various indicia can be imprinted onto the outer layer of "TYVEK" type material. There is no limitation as to the type of indicia and such indicia include ornamental designs and, for example, logos, fanciful designs, maps, art work, photographs, etc. Printing on the "TYVEK" type material can be accomplished using various techniques including, inter alia, off-set printing, gravure printing, silk screen printing and transfer and puff transfer printing. Additionally, the apparel may be further decorated by embroidery work.

The fabric lining may be sewn to the non-woven spun bonded olefin outer layer by stitching through the layers. In the case where a closure means, such as a zipper or Velcro, is attached, a preferred special technique along the border leads to improved strength. An edge of the two ply laminate of the outer "TYVEK" layer and inner fabric lining layer are folded over so that there are two places where the inner fabric lining layer has to be sewn and two places where the "TYVEK" layer has to be sewn. When so-folded and a closure means such as a zipper is sewn to the so-folded material, the attachment is about four times stronger than the strength of a closure means attachment in a unlined "TYVEK" material.

In making clothing apparel or apparel accessories, the outer "TYVEK" type layer and fabric lining can be bonded or sewn and this new fabric material cut into appropriate pieces and sewn to a finished product. Alternatively, the fabric lining and the "TYVEK" type material may be separately cut into identical patterns and then sewn together to make the final product. Either way, the resulting product is substantially different from a product made from a "TYVEK" type material alone. A product such as a garment made from the new material of the present invention has weight and substance as opposed to the paper-like feel and look of a product made from "TYVEK" alone.

Using the new material of the present invention, products never made before can be made. Such a product might be, for example, sweatshirts, sweatpants, skirts, hats, tote bags.

Totally new and unique articles of apparel and apparel accessories can be made which are water, stain and wind resistant and which do not have the above-mentioned disadvantages of articles made from "TYVEK" alone.

I claim:

1. A fabric material having a good hand and substantial feel which is suitable for making clothing apparel and apparel accessories said material comprising an outer layer of a non woven spun bonded olefin fabric material which is waterproof, windproof and weather-resistant to which is sewn or bonded a fabric lining layer of a natural or synthetic fiber or a blend thereof, said lining may be optionally fleeced.

2. A fabric material according to claim 1, wherein the fabric lining layer is resistant to shrinkage upon washing.

3. A fabric material according to claim 1, wherein the fabric lining layer is sewn to the outer layer.

4. A fabric material according to claim 3, wherein at least 11 stitches per inch are employed in sewing together the outer nonwoven spun bonded olefin layer and the fabric lining layer.

5. A fabric material according to claim 1, wherein the fabric lining layer is a cotton/blend.

6. A fabric material according to claim 1, wherein the lining layer is a cotton/polyester blend.

7. A fabric material according to claim 1, wherein the outer layer has indicia printed thereon.

8. Clothing apparel or an apparel accessory made from a fabric material according to claim 1.

9. Clothing material or an apparel accessory made from a fabric material according to claim 2.

10. Clothing apparel or an apparel accessory made from a fabric material according to claim 3.

11. Clothing apparel or an apparel accessory made from a fabric material according to claim 4.

12. Clothing apparel or an apparel accessory made from a fabric material according to claim 5.

13. Clothing apparel or an apparel accessory made from a fabric material according to claim 6.

14. Clothing apparel or an apparel accessory made from a fabric material according to claim 7.

15. A fabric material according to claim 7, wherein the indicia is printed onto the outer layer by off-set printing, gravure printing, silk screen printing, transfer printing or puff printing.

* * * * *